US005448458A

United States Patent [19]

Smyly, Jr.

[11] Patent Number: 5,448,458

[45] Date of Patent: Sep. 5, 1995

[54] HAND MOUNTING OF ILLUMINATION DEVICE

[76] Inventor: Douglas B. Smyly, Jr., 102 Pinehurst Rd., Trussville, Ala. 35173

[21] Appl. No.: 266,436

[22] Filed: Jun. 23, 1994

[51] Int. Cl.[6] ..... F21L 15/08

[52] U.S. Cl. ..... 362/103; 362/190; 362/32

[58] Field of Search ..... 362/103, 190, 191, 32, 362/804

[56] References Cited

U.S. PATENT DOCUMENTS

| | | | |
|---|---|---|---|
| 914,975 | 3/1909 | Radley | 362/103 |
| 1,230,943 | 6/1917 | Sundh | 306/103 |
| 1,754,570 | 4/1930 | Picket | 362/104 |
| 3,112,889 | 12/1963 | Marmo | 362/103 |
| 5,086,378 | 2/1992 | Prince | 362/103 |
| 5,255,167 | 10/1993 | Toussaint | 362/103 |
| 5,345,368 | 9/1994 | Huff | 362/103 |

FOREIGN PATENT DOCUMENTS

| | | | |
|---|---|---|---|
| 35018 | 5/1965 | Finland | 362/103 |

*Primary Examiner*—Ira S. Lazarus
*Assistant Examiner*—L. Heyman
*Attorney, Agent, or Firm*—Kenneth Lee Cleveland

[57] ABSTRACT

A hand mounting of illumination device. A common flashlight or other light source is mounted on the hand between the metacarpal bones of the thumb and forefinger. This directs the light to the area where the fingers meet and where common hand tools operate and allows full use of the hand holding the light source.

6 Claims, 3 Drawing Sheets

HAND MOUNTING OF ILLUMINATION DEVICE

FIELD OF THE INVENTION

The present invention relates to a device to mount a light source such that light may be directed to the point where the fingers meet or hand tools held in the fingers operate.

BACKGROUND OF THE INVENTION

Many work applications require that light be directed to the point where the fingers meet or that light be directed to the point where tools held in the hands are operating. Common hand tools such as pliers, screwdrivers, and the like are often used in locations where there is little light. Flashlights are the traditional method of supplying light to the point where the work is being performed. Hand held flashlights have two major drawbacks. First, is the inability to use both hands while holding a common flashlight. Second, is the inability to get the hand holding the flashlight, the hand that is working and the head into a small space so that the person can see the work to be done.

Several early flashlight devices had finger rings so that they could be supported on the hand. U.S. Pat. No. 914,975, dated Mar. 9, 1909, to G. R. Radley and U.S. Pat. No. 1,754,570, dated Apr. 15, 1930, to J. P. Picket represent such devices. Flashlights have also been mounted on the wrist or top of the hands as in U.S. Pat. No. 3,112,889, dated Dec. 3, 1963, to M. L. Marmo. More recently, U.S. Pat. No. 5,255,167, dated Oct. 19, 1993, to Toussaint and U.S. Pat. No. 5,086,378, dated Feb. 4, 1992, to Prince, mounted a light source on the fingers for the purpose of directing light.

None of these devises allowed the use of the hand holding the flashlight while directing the light to the place it was needed most.

SUMMARY OF THE INVENTION

It is the object of the present invention to provide a device whereby a light source such as a common flashlight can be mounted on the hand with the light emitted by the light source directed to the location where the fingers meet or where common hand held tools operate. Placing the light source between the metacarpal bones of the thumb and forefinger on the hand positions the light source to shine where the fingers meet. The present invention is far superior to prior art. The utility is further enhanced when the light source is removably attached so that it can be repositioned to shine the light where it is most needed if tools are changed.

These and other objects of the invention are achieved by providing a device mounting the light source on the surface of the skin of the hand on between the metacarpal bones of the thumb and forefinger. The device will work with any light source which has a housing for the light source which directs and focuses the light source to a point in space. The light source most commonly used will be a small flashlight but can be a specially built light, fiber optic cable or other light source. The device includes a means for releasably attaching the light source housing to the hand. The light source is releasably secured to the hand in order that it may be adjusted to reposition the light when tools are changed.

For example, where the light source is a common hand held flashlight, and a strap is used to secure the flashlight to the hand, it could be attached to the strap using glue, bolts, rivets or similar means. The flashlight would be aimed in the direction of the meeting point of the thumb and index finger or forefinger with the illuminated area sufficient large for a person to be able to see in that general area and use tools such as a standard screwdriver, pliers, wire cutters, or other common hand tools. Alternatively, the flashlight may be releasably attached by a snap, buttons or other means so that the focal point of the light may be shifted as needed. The preferred method of doing this is to use loop and hook fabric, commonly sold under the trade name, (Velcro), with one part connected to the flashlight housing by elastic bands and the other part being sewn to the strap. Because of the curvature of the hand as the light source is adjusted closer to the fingers, the focal point of the light moves closer to the point where the fingers meet and as the light source is moved further back toward the wrist, the focal point is moved further away from where the fingers meet.

The light source may include one or more batteries contained in its housing or may be connected by wires to a remote power source located elsewhere on the person of the use, the ground, or even plugged in to a common electrical outlet. The strap may entirely consist of hook and loop fastener (Velcro) hook or loop strip of the hook and loop fastener attached to a glove or another strap which is secured to the hand.

DETAILED DESCRIPTION OF THE PREFERRED EMBODIMENT

Figure 1:
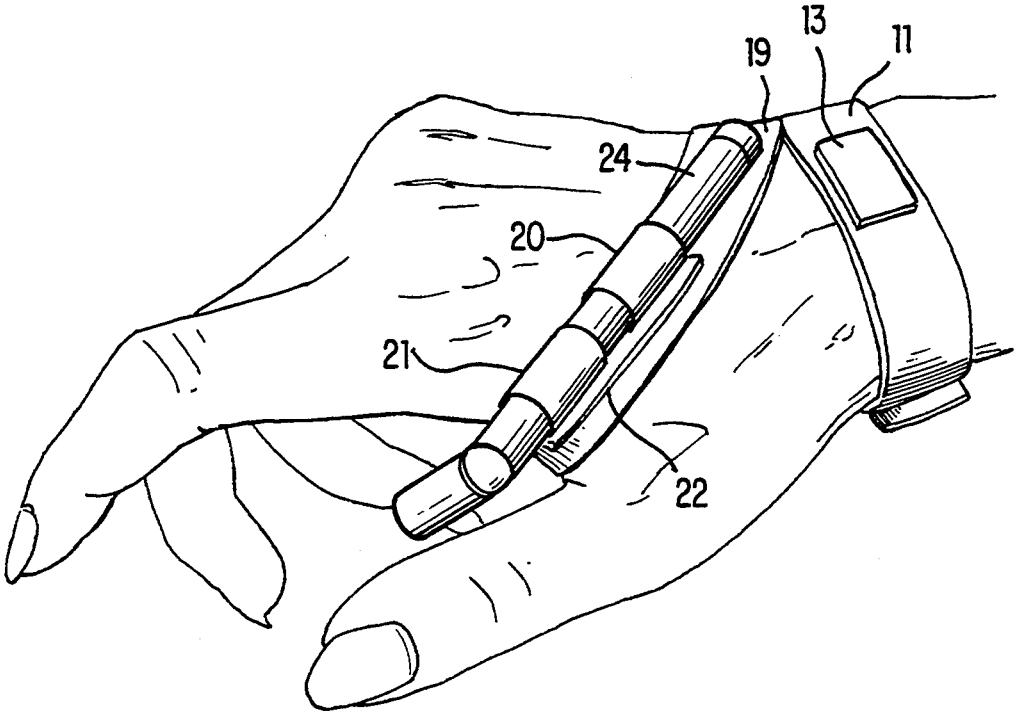
FIG. 1 is a side view showing the device as attached to the right hand.
Figure 2:
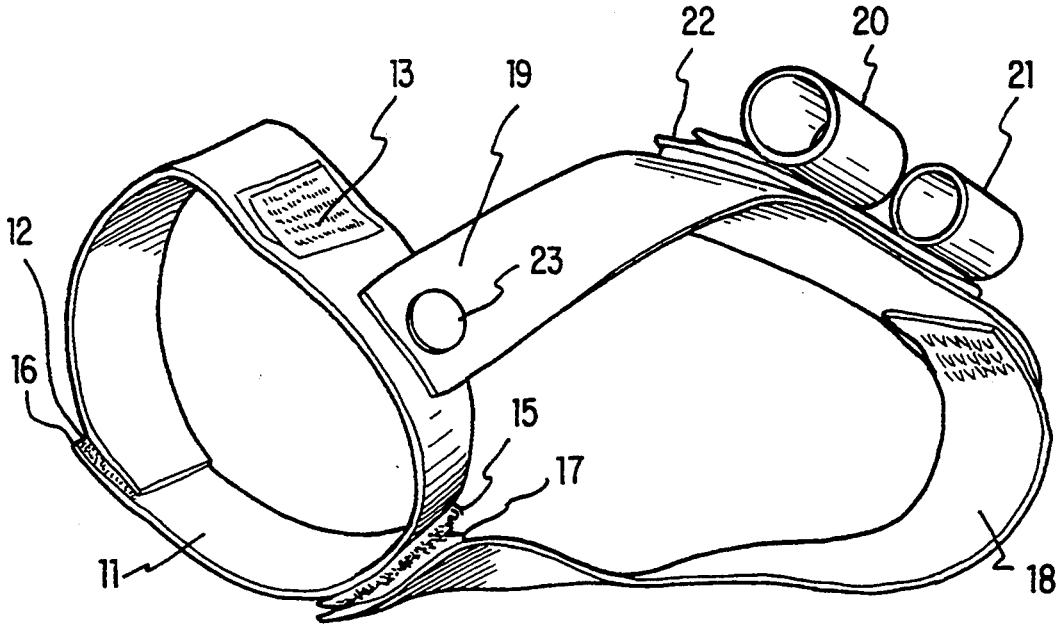
FIG. 2 is a side view showing the device without a hand.
Figure 3A:
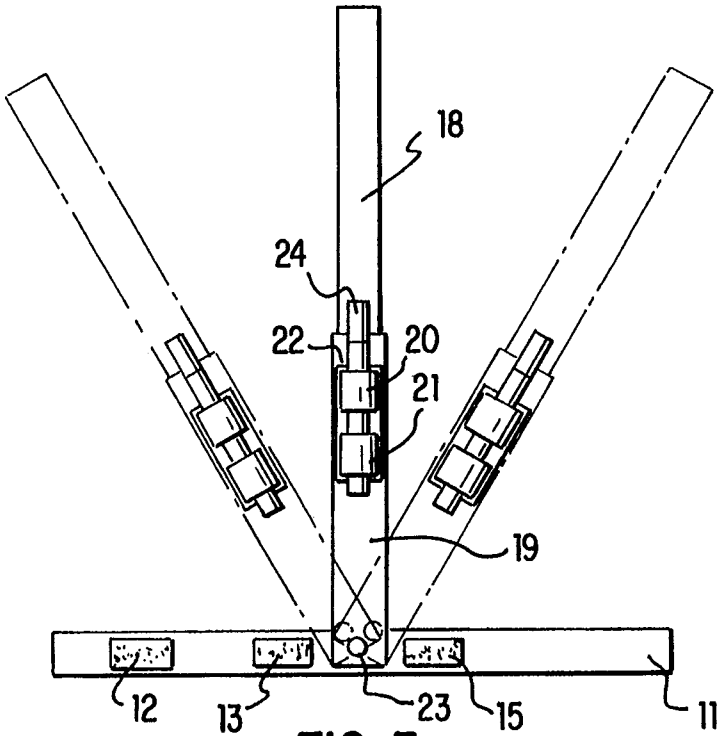
FIG. 3*a* is a top view.
Figure 3B:
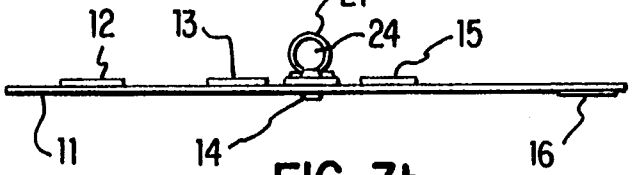
FIG. 3*b* is a side view of wrist portion of the strap.
Figure 3C:
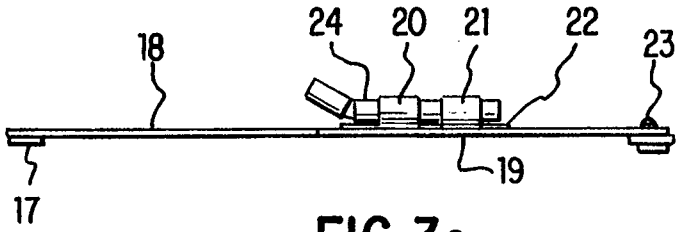
FIG. 3*c* is a side view of the hand portion of the strap.

Referring in detail to the drawings wherein like references refer to like parts as shown in FIGS. 1, 2 & 3. The device as shown in FIG. 3*a* is comprised of a wrist portion 11, a hand portion 18 and 19 connected by a snap 23 and 14, with a flashlight connecting portion 20, 21, and 22. The wrist portion as shown in FIG. 3*b* is comprised of strap portion 11 to which a loop strip 12 is sewn, a hook strip 13 is sewn, a hook strip 15 is sewn and a hook strip 16 is sewn, and contains snap bottom 14. The hand portion is comprised of a hook strip 19 which is sewn to strap 18, a loop strip 17 which is sewn to strap 18, and snap top 23. The strap portion will connect at the top and bottom of the wrist running between the thumb and forefinger and along the top of the hand between the metacarpal bones of the thumb and forefinger of either left or right hand. The flashlight connecting portion is comprised of elastic straps 21 and 20 sewn to loop strip 22.

The device adjustably secures a flashlight to the hand at the location between the metacarpal bones of the thumb and forefinger. Elastic strap 11 connected by a snap, the top of which is 23 (FIG. 3*c*) and the bottom of which is 14, (FIG. 3*b*) which allows the device to be worn on either the left hand or the right hand . The fastener strips 16 and 12 are sewn on strap 11 so that they will removably secure strap 11 around the wrist as shown in FIG. 2. Fastener strips 13 and 15 are sewn on strap 11 such that fastener strip 17 on strip 18 matches fastener strap 13 for the left hand or fastener strip 15 for the right hand. Fastener strip 19 is sewn to strap 18, so that each is approximately half the length of the hand portion. On fastener strip 22, the elastic straps 20 and 21 are sewn. Flashlight 24 is removably held in position by elastic straps 20 and 21 and is releasably attached to the hand portion by connecting fastener strip 22 and fastener strip 19.

While I have illustrated and described the preferred embodiment of the invention, it is understood that there are many variations and modifications and that I therefore, do not wish to be limited to the precise details set forth, but desire to avail myself of such changes, alteration or equivalents as fall within the purview of the following claims.

I claim:

1. A hand mounting of illumination device comprising:

a strap releasably attached to a human hand aligned so that a portion runs on the surface of the skin between the metacarpal bones of the thumb and forefinger from the top of the wrist to the bottom of the wrist and between the thumb and forefinger and, a means for releasably attaching a flashlight to the strap portion running between said metacarpal bones, and a means for releasably securing a flashlight to the strap portion running between said metacarpal bones.

2. A hand mounting of illumination device comprising: a flashlight;

a strap releasably attached to a human hand aligned so that a portion runs on the surface of the skin between the metacarpal bones of the thumb and forefinger from the top of the wrist to the bottom of the wrist and between the thumb and forefinger, a means for releasably attaching the flashlight to the strap between the metacarpal bones of the thumb and forefinger.

3. A hand mounting of illumination device comprising:

a directional light emitting source;

a housing for the light emitting source;

a strap releasably attached to a human hand aligned so that a portion runs on the surface of the skin between the metacarpal bones of the thumb and forefinger from the top of the wrist to the bottom of the wrist between the thumb and forefinger;

a means for releasably attaching said housing to the strap between the metacarpal bone of the thumb and forefinger.

4. A hand mounting of illumination device comprising:

a first strap portion;

a means for releasably attaching said first strap portion to the wrist;

a second strap portion;

a means for releasably attaching the second strap portion to the first strap portion such that the second strap portion will connect at the top and bottom of the wrist and running between the thumb and forefinger and along to the top of the hand between the metacarpal bones of the thumb and forefinger of either the left or right hand;

a means for releasably attaching a flashlight to the second strap along the said portion that runs between the metacarpal bones of the thumb and forefinger.

5. A hand mounting of illumination device comprising:

a fiber optic cable;

a strap releasably attached to a human hand aligned so that a portion runs on the surface of the skin between the metacarpal bones of the thumb and forefinger from the top of the wrist to the bottom of the wrist and between the thumb and forefinger;

a means for releasably attaching the fiber optic cable to the strap between the metacarpal bones of the thumb and forefinger.

6. The device in claim 4 wherein the means for releasably attaching said first strap portion to the wrist is comprised of loop and hook fastener wherein said first strap portion is connected to said second strap portion by a snap allowing said second strap portion to rotate relative to said first strap portion at one end and hook and loop fastener at the other end aligned so that the second strap will fit either the left or right hand, wherein the means for attaching a flashlight to the second strap comprised of a loop strip of a loop and hook fastener secured to the flashlight by at least one plastic band and a hook strip of a loop and hook fastener sewn into said second strap portion.

* * * * *